US008221160B2

(12) United States Patent
Liu et al.

(10) Patent No.: US 8,221,160 B2
(45) Date of Patent: Jul. 17, 2012

(54) CONNECTOR ASSEMBLY HAVING GROUNDING MEANS

(75) Inventors: Heng Liu, Shenzhen (CN); Xian-Kui Shi, Shenzhen (CN); Chung-Yen Yang, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 17 days.

(21) Appl. No.: 12/968,299

(22) Filed: Dec. 15, 2010

(65) Prior Publication Data

US 2011/0143593 A1 Jun. 16, 2011

(30) Foreign Application Priority Data

Dec. 15, 2009 (CN) ..... 2009 2 0317447

(51) Int. Cl.
*H01R 13/60* (2006.01)

(52) U.S. Cl. ..... 439/540.1; 439/76.1; 439/731

(58) Field of Classification Search ..... 439/76.1, 439/701, 540.1, 731, 620.22
See application file for complete search history.

(56) References Cited

U.S. PATENT DOCUMENTS

| | | | | |
|---|---|---|---|---|
| 2003/0092314 | A1* | 5/2003 | Whiteside et al. | 439/540.1 |
| 2007/0184712 | A1* | 8/2007 | Martich et al. | 439/540.1 |
| 2009/0117766 | A1* | 5/2009 | Khemakhem et al. | 439/188 |
| 2009/0269977 | A1* | 10/2009 | Chen et al. | 439/540.1 |

FOREIGN PATENT DOCUMENTS

| | | |
|---|---|---|
| CN | 1144326 | 3/2004 |

* cited by examiner

*Primary Examiner* — Hien Vu
(74) *Attorney, Agent, or Firm* — Wei Te Chung; Andrew C. Cheng; Ming Chieh Chang

(57) ABSTRACT

A connector assembly (100) includes an insulative cover (11, 12) defining an interior and an exterior, and the insulative cover having at least one platform (18) disposed outside of the interior thereof; a printed circuit board (3) located in the interior of the insulative cover; at least one connector (2) mounted to the printed circuit board; and a conductive member (4) fixed to the insulative cover, said conductive member (4) including a main body (41), an arm (42) extending forwardly from the main body and a spring finger (43) formed at a front edge of the arm, the main body supported by the platform, the spring finger contacting the printed circuit board.

16 Claims, 6 Drawing Sheets

CONNECTOR ASSEMBLY HAVING GROUNDING MEANS

BACKGROUND OF THE INVENTION

1. Field of the Invention

The present invention relates to a connector assembly, more particularly to a connector assembly with improved grounding means.

2. Description of Related Art

Nowadays, an electronic device is lower profile and multifunctional. So accessories are attached to the electronic device, such as connector assembly should be transmitting fast, smaller contour, simplified and friendly usage. USB and Audio jack are commonly input/output interfaces for a computer or other consumer device, and those interfaces are commonly mounted to a cage of a computer or other electronic devices and to link with other peripheral devices. CN Pat. No. 1144326 issued on Mar. 31, 2004 to Ko et al. discloses a connector assembly adapted for mounting to a cage of a computer. The connector assembly includes an external cover and two USB connector enclosed in the external cover. Two bolts are assembled to lateral sides of a front side of the external cover, and a conductive pad with a hole therein is threaded and assembled to each bolt and further contacts a metallic shell of the corresponding USB connector to achieve better grounding function. However, relation between the conductive pad and the metallic shell may loose, after the USB connector mates again and again with its counterpart.

Hence, a connector assembly with improved grounding device is desired.

BRIEF SUMMARY OF THE INVENTION

Accordingly, an object of the present invention is to provide a connector assembly which has reliable grounding means.

In order to achieve the above-mentioned object, a connector assembly in accordance with present invention comprises an insulative cover defining an interior and an exterior, and the insulative cover having at least one platform disposed outside of the interior; a printed circuit board located in the interior of the insulative cover; at least one connector mounted to the printed circuit board; and a conductive member fixed to the insulative cover, said conductive member including a main body, an arm extending forwardly from the main body and a spring finger formed at a front edge of the arm, the main body supported by the platform, the spring finger contacting the printed circuit board.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
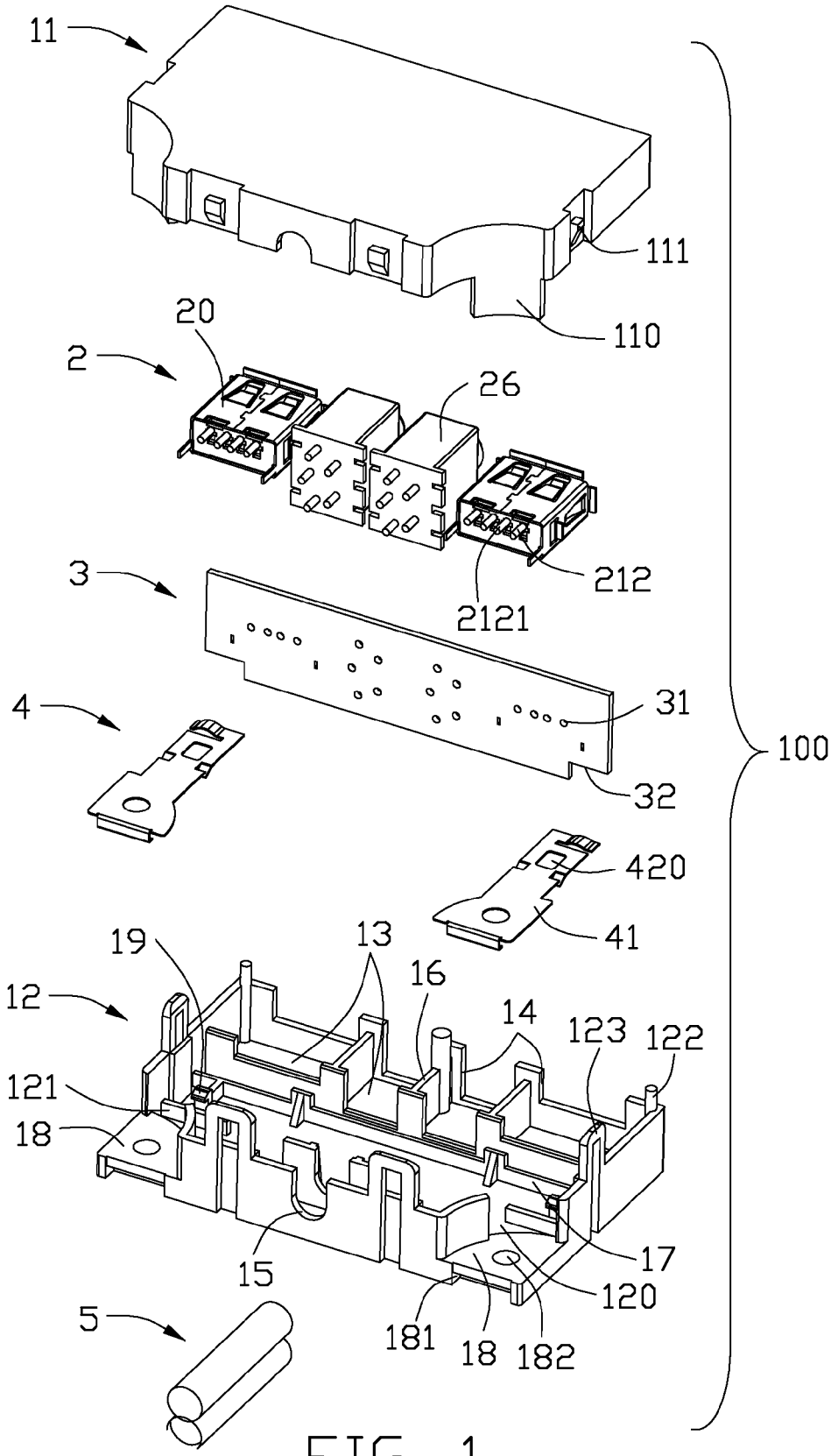
FIG. 1 is an exploded, perspective view of a connector assembly.

In the following description, numerous specific details are set forth to provide a thorough understanding of the present invention. However, it will be obvious to those skilled in the art that the present invention may be practiced without such specific details.

Reference will be made to the drawing figures to describe the present invention in detail, wherein depicted elements are not necessarily shown to scale and wherein like or similar elements are designated by same or similar reference numeral through the several views and same or similar terminology.

Figure 2:
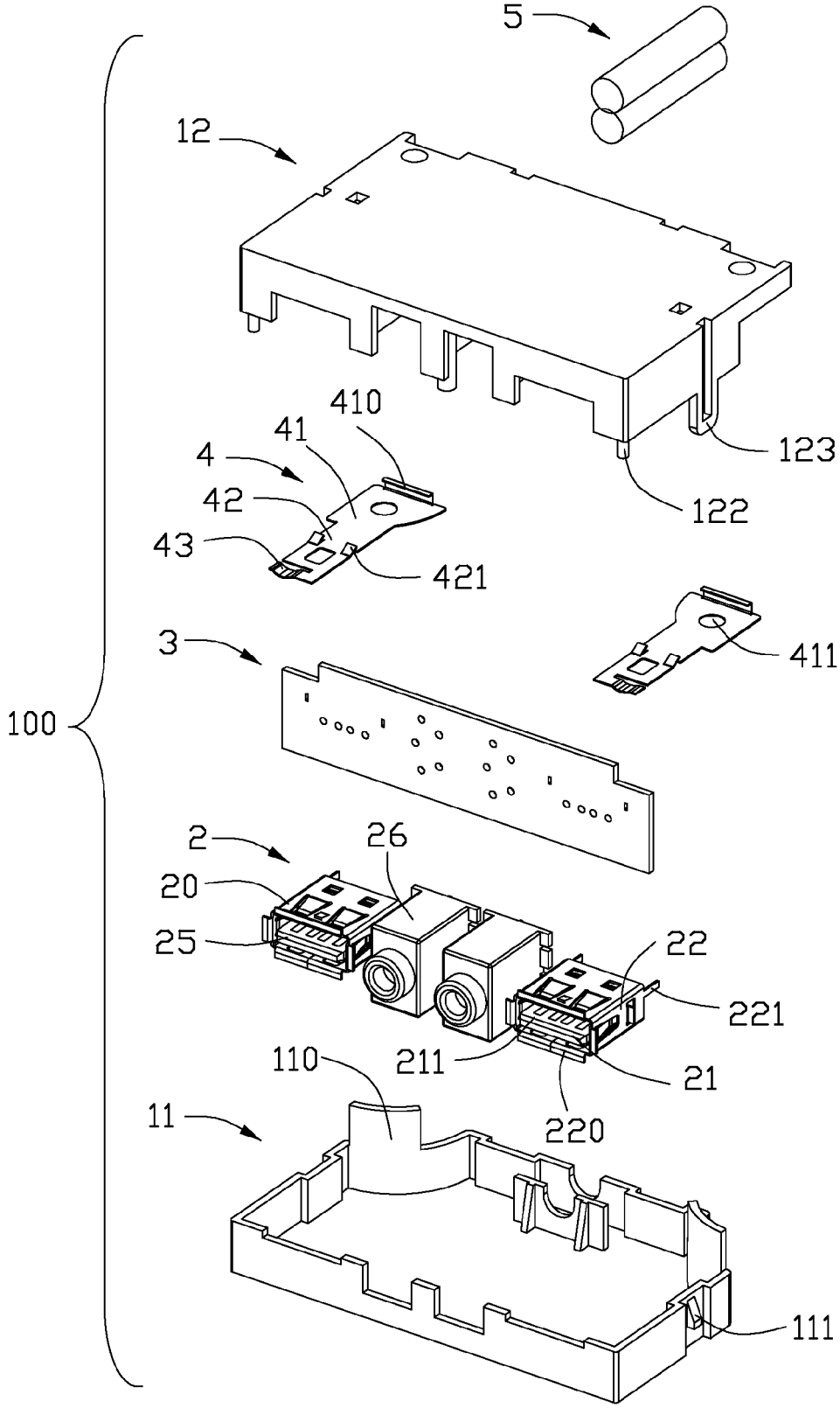
FIG. 2 is similar to FIG. 1, with a top cover is removed upwardly.
Figure 3:
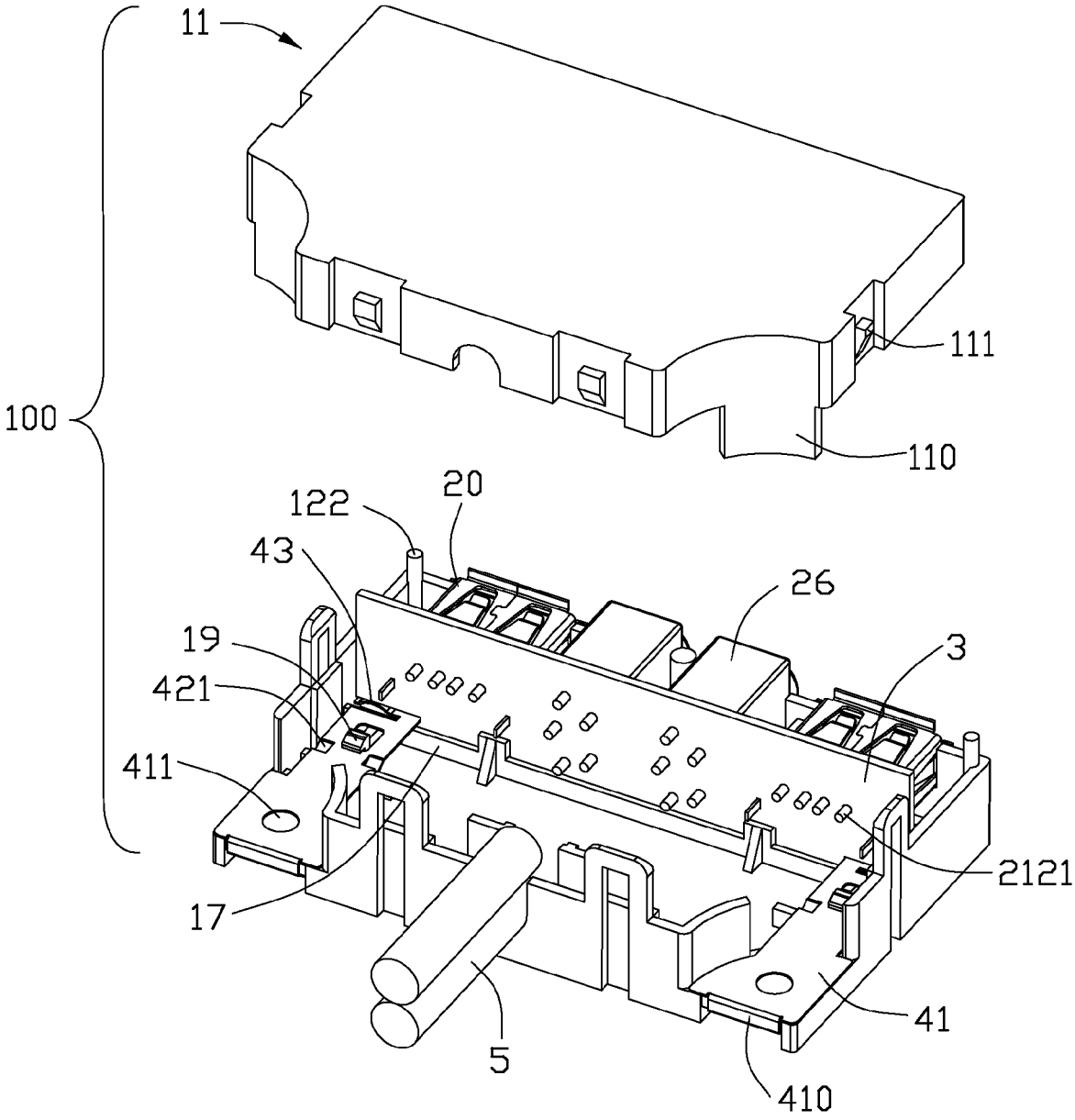
FIG. 3 is a partially assembled, perspective view of the connector assembly.
Figure 4:
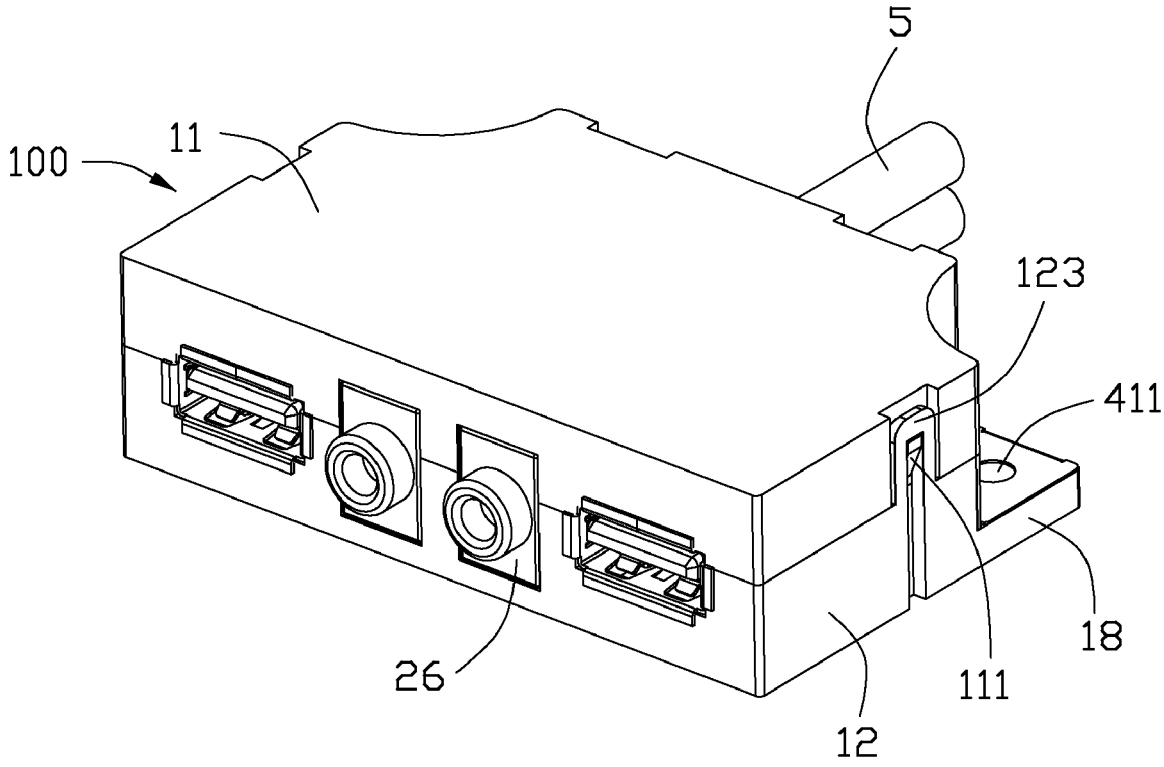
FIG. 4 is an assembled, perspective view of the connector assembly.
Figure 5:
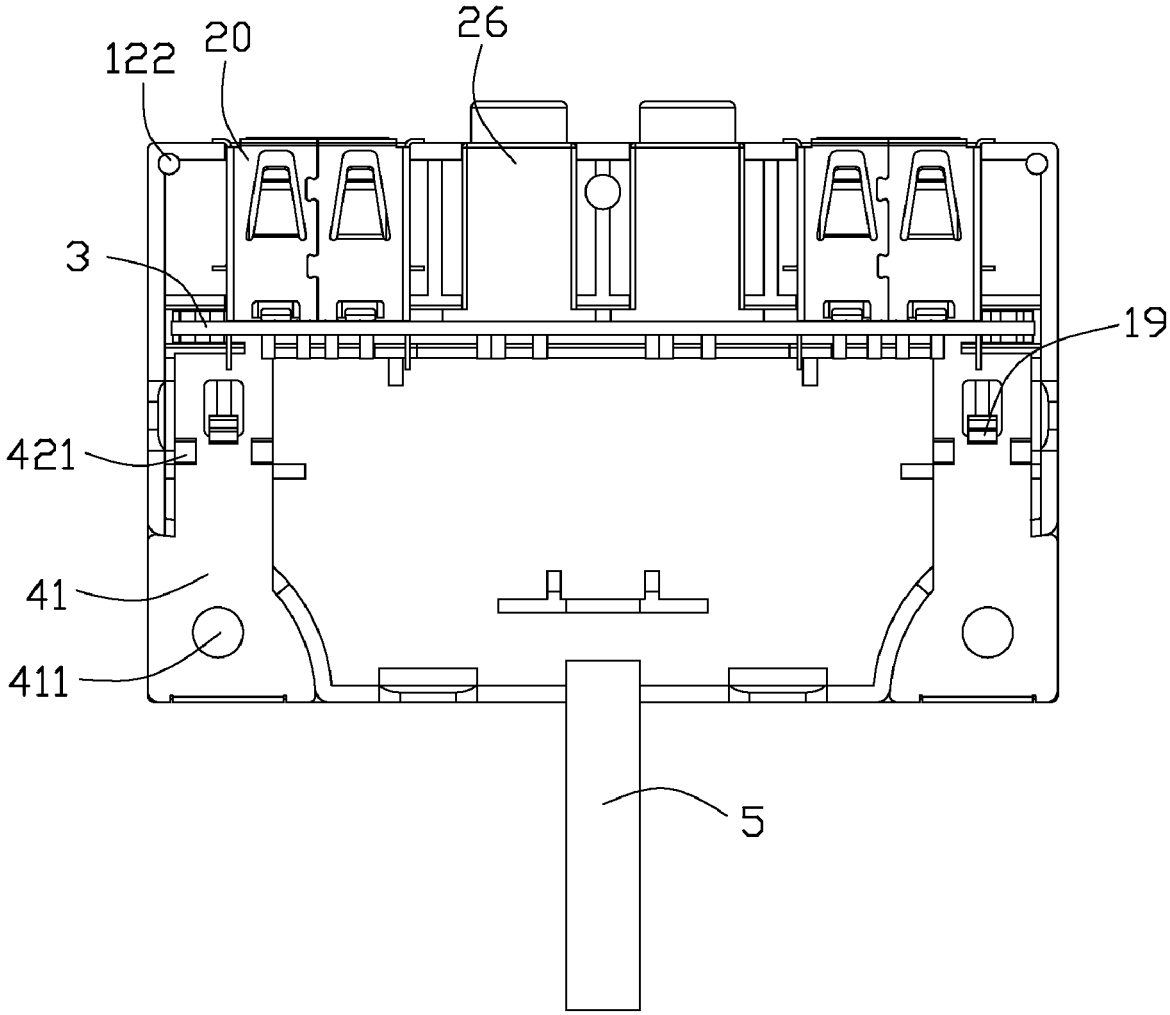
FIG. 5 is top side view of FIG. 3, after the top cover is removed away.
Figure 6:
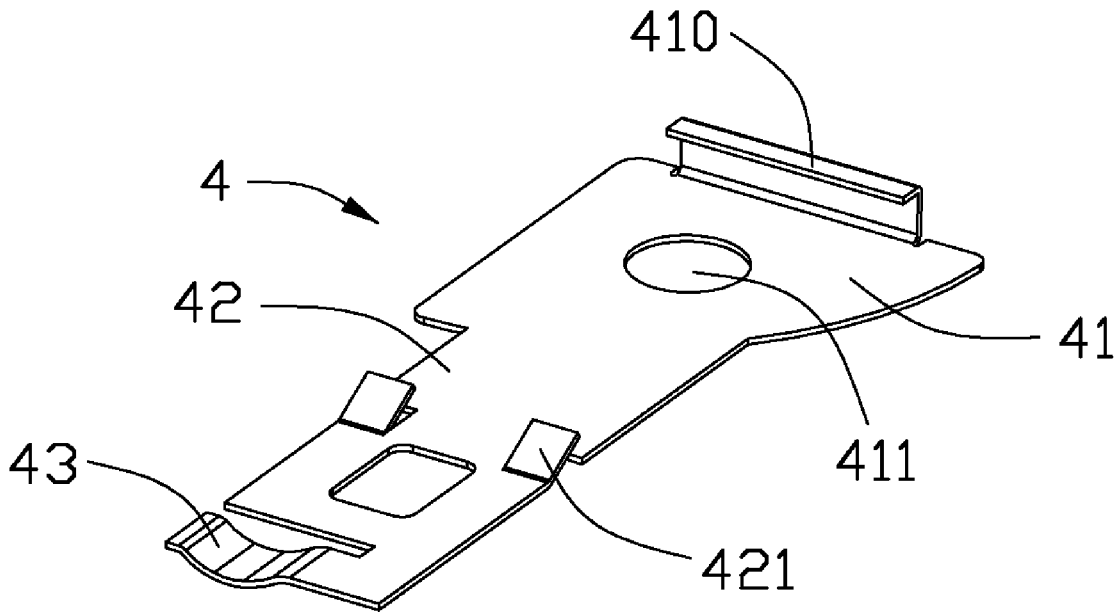
FIG. 6 is an enlarged view of a conductive member.

Referring to FIGS. 1-6, a connector assembly 100 in accordance with the present invention comprises an insulative cover, a number of connectors 2, a printed circuit board 3, two conductive members 4 and a number of cables 5. Detail description of these elements and their relationship and other elements formed thereon will be detailed below.

The insulative cover includes a top cover 11 and a bottom cover 12. The top cover 11 and the bottom cover 12 together to define an interior and an exterior. There are four grooves 13 located in front segment of the interior of the insulative cover. Every two adjacent grooves 13 are separated by a spacer 16. Each of the grooves 13 has a front opening 14 which is defined in a front wall (not numbered) of the insulative cover, and a cable outlet 15 is defined in a back side of the insulative cover. Thus, the interior of the insulative cover may ventilate/communicate with the exterior via the front opening 14 and the cable outlet 15. Inside an interior of the bottom cover 12, there is a transversal beam 17 formed on a middle segment of an lower wall (not numbered) of the bottom cover 12, and two latching portions 19 project upwardly from the lower wall of the bottom cover 12 and are arranged in front of the lateral sides of the transversal beam 17. There are also two bars 121 formed on the lower wall of the bottom cover 12 and disposed behind the two latching portions 19. Outside the interior of the bottom cover 12, there are two platforms 18 respectively arranged at two corners of the bottom cover 12. A notch 181 is located in a back end of a lower portion of each platform 18. There is a first through hole 182 defined in a middle section of each platform 18. The platform 18 are disposed outward of a back wall (not numbered) and side walls (not numbered) of the bottom cover 12, with two passages 120 respectively defined in lateral sides of the back wall. The top cover 11 has similar contour with the bottom cover 12, and there are two doors 110 extending downwardly from lateral sides of a back wall (not numbered) of the top cover 11 and accommodated in the two passages 120, respectively. There are also a number of aligning posts 122 formed on the bottom cover 12. Two locking tabs 111 are arranged on the side walls of the top cover 11 and two clasps 123 extend upwardly from the two side walls of the bottom cover 12. The clasps 123 engage with the locking tabs 111 so as to keep the top cover 11 and the bottom cover 12 together.

The connectors 2 are accommodated in the grooves 13. The connectors 2 includes two audio jacks 26 disposed in juxtaposed manner and two USB connectors 20 respectively arranged at lateral sides of the two audio jacks 26. Each USB connector 20 includes a terminal module 21 and a metallic shell 22 enclosing the terminal module 21. The terminal module 21 and the metallic shell 22 together define a mating port 25 exposed in the exterior of the insulative cover via the front opening 14. The metallic shell 22 has an expanded front end 220 and two rearwardly extended legs 221 apart from each other along a transversal direction. The terminal module 21 has a dielectric body 211 and a plurality of terminals 212 supported by the dielectric body 211.

The printed circuit board 3 has a plurality of holes 31 to allow tail portions 2121 of the terminals 212 and legs 221 of the metallic shells 22 passing through. The printed circuit board 3 is erectly disposed and sandwiched between the spacers 16 and the transversal beam 17. There are two cutouts 32 defined in lateral corners of the printed circuit board 3.

Each of the two conductive members 4 is made of metal sheet and includes a main body 41, an arm 42 extending forwardly from the main body 41 and a spring finger 43 formed at a front edge of the arm 42. There is an engaging portion 410 protrudes downwardly from a back edge of the main body 41. Furthermore, there is second through hole 411 defined in the main body 41. There is positioning cavity 420 defined in the arm 42. In addition, there are two spring tabs 421 formed at lateral sides of the arm 42. The spring tabs 421 extend downwardly and rearwardly.

Each cable 5 has a number of wires (not shown) and are respectively soldered to the tail portions 2121 of the terminals 212. The cables 5 exit the insulative cover 5 via the cable outlet 15.

When assembling, the conductive members 4 are fixed to the bottom cover 12, with the main body 41 supported by the platform 18, the engaging portion 410 latching with the notch 181 of the platform 18, the second through hole 411 aligning with the first through hole 182. The arm 42 is supported by the bar 121, the latching portion 19 locked into the positioning cavity 420 of the arm 42, and the two spring tabs 421 disposed in front of and abutting against the bar 121. The connectors 2 are mounted to the printed circuit board 3, with tail portions 2121 of the terminals 212 and legs 221 of the metallic shell 22 passing through the holes 31 of the printed circuit board 3, therefore, the connectors 2 electrically connected with the printed circuit board 3. The printed circuit board 3 is mounted to the bottom cover 12, with the spring finger 43 extending into the cutout 32 of the printed circuit board 3 and contacting an inner side of the cutout 32 so as to form an electrical connection therebetween. In order to achieve better electrical connection, the cutout 32 may be plated with a copper layer. The top cover 11 is assembled to the bottom cover 12, with the connectors 2 held between the top cover and the bottom cover 12, the arm 42 sandwiched between the platform 18 and the door 110.

The connector assembly 100 is mounted to a cage of a computer, with a corresponding metallic bolt (not shown) threaded the first through hole 182 and the second through hole 411. Thus, the connector assembly 100 and the cage of the computer forms a grounding line therebetween.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

What is claimed is:

1. A connector assembly, comprising:

an insulative cover defining an interior and an exterior, and the insulative cover having at least one platform disposed outside of the interior;

a printed circuit board located vertically in the interior of the insulative cover;

at least one connector mounted to the printed circuit board; and a conductive member fixed into the insulative cover, said conductive member including a main body, an arm extending forwardly from the main body and a spring finger formed at a front edge of the arm, the main body supported by the platform, the spring finger contacting the printed circuit board;

wherein an engaging portion is formed at a back edge of the main body, and the engaging portion latches with a notch which is defined in the platform;

wherein the insulative cover has a bar located in the interior thereof, and there is a spring tab formed on the arm and abutting against the bar; and wherein the platform is arranged at a corner of the insulative cover.

2. The connector assembly as claimed in claim 1, wherein there is a first through hole defined in the platform and a second through hole defined in the main body of the conductive member, and the first through hole aligns with the second through hole.

3. The connector assembly as claimed in claim 1, wherein the arm is supported by the bar.

4. The connector assembly as claimed in claim 1, wherein there is a latching portion disposed behind the bar, and the latching portion is locked into a positioning cavity which is defined in the arm.

5. The connector assembly as claimed in claim 1, wherein the printed circuit board is erectly arranged inside the interior of the insulative cover.

6. The connector assembly as claimed in claim 5, wherein the printed circuit board defines a cutout at a corner thereof, and the spring finger of the conductive member extends into the cutout of the printed circuit board.

7. The connector assembly as claimed in claim 1, wherein the insulative cover includes a top cover and a bottom cover combined together to hold the connector.

8. The connector assembly as claimed in claim 7, wherein there is a passage defined in a back wall of the bottom cover, and the conductive member extends into the interior of the insulative cover via the passage.

9. The connector assembly as claimed in claim 8, wherein there is a door extending downwardly from a back wall of the top cover and accommodated in the passage.

10. An electrical connector assembly comprising:

a cover device including first half and second half commonly defining an interior space;

a plurality of connector disposed in a front portion of the interior space with corresponding mating ports forwardly exposed to an exterior in a mating direction;

a cable disposed in a rear portion of the interior space and extending rearwardly out of the cover device into the exterior;

a printed circuit board vertically disposed in a middle portion of the interior space connecting to said connectors and said cable, respectively;

a pair of conductive members each having a front segment forwardly extending into the interior space and a rear segment exposed to the exterior in both a vertical direction and a lateral direction perpendicular to each other and both further perpendicular to the mating direction;

wherein the front segment of each of said conductive member further includes a spring finger mechanically and electrically connecting to a grounding conductor of the printed circuit board; and wherein the printed circuit board defines a cutout at a corner thereof, and the spring finger of the conductive member extends into the cutout of the printed circuit board.

11. The electrical connector assembly as claimed in claim 10, wherein the conductive member is essentially sandwiched between the first half and the second half.

12. The electrical connector assembly as claimed in claim 11, wherein both the rear segment of the conductive member and one of the first half and the second half commonly define a screw hole in the vertical direction.

13. The electrical connector assembly as claimed in claim 10, wherein the conductive member and the cover device are configured to allow the conductive member to be assembled the second half only in the vertical direction.

14. The electrical connector assembly as claimed in clam 13, wherein the printed circuit board is configured to be assembled into the cover device only after the conductive member is assembled to the cover device so as not to result in interference.

15. An electrical connector assembly comprising:

a cover device including first half and second half commonly defining an interior space;

a plurality of connector disposed in a front portion of the interior space with corresponding mating ports forwardly exposed to an exterior in a mating direction;

a cable disposed in a rear portion of the interior space and extending rearwardly out of the cover device into the exterior;

a printed circuit board disposed vertically in a middle portion of the interior space and connecting to said connectors and said cable, respectively, said printed circuit board defining therein a pair of notches at corners thereof and provided with grounding paths thereof; and a pair of conductive members having a pair of spring fingers at ends thereof received in said notches and electrically connected to the corresponding grounding paths, respectively;

wherein said pair of conductive members cooperate with the cover device to define a pair of screw holes thereof.

16. The electrical connector assembly as claimed in claim 15, wherein said printed circuit board extends in a vertical direction perpendicular to said mating direction, and said pair of notches are located at two lateral sides of the printed circuit board in a lateral direction perpendicular to both said mating direction and said vertical direction.

* * * * *